US005348802A

United States Patent [19]

Matsuhisa et al.

[11] Patent Number: 5,348,802

[45] Date of Patent: Sep. 20, 1994

[54] CARBON FIBER MADE FROM ACRYLIC FIBER AND PROCESS FOR PRODUCTION THEREOF

[75] Inventors: Yoji Matsuhisa, Iyo; Toru Hiramatsu, Matsuyama; Kazuo Yoshida, Akigawa; Gen Katagiri, Otsu, all of Japan

[73] Assignees: Toray Industries, Inc.; Toray Research Center, Inc., Japan

[21] Appl. No.: 899,952

[22] Filed: Jun. 17, 1992

Related U.S. Application Data

[63] Continuation of Ser. No. 456,317, Dec. 26, 1989, abandoned.

[30] Foreign Application Priority Data

Dec. 26, 1988 [JP] Japan ..... 63-329940
Sep. 27, 1989 [JP] Japan ..... 1-256024

[51] Int. Cl.[5] ..... B32B 9/00; D02G 3/00

[52] U.S. Cl. ..... 428/367; 428/364; 428/372; 428/379; 428/400; 423/447.2; 423/447.4

[58] Field of Search ..... 428/367, 400; 423/447.2, 447.4

[56] References Cited

U.S. PATENT DOCUMENTS

| | | | |
|---|---|---|---|
| Re. 33,537 | 2/1991 | Hiramatsu et al. | 423/447.2 |
| 3,925,524 | 12/1975 | Kimmel et al. | 423/447.4 |
| 4,024,227 | 5/1977 | Kishimoto et al. | 423/447.4 |
| 4,600,572 | 7/1986 | Hiramatsu | 423/447.2 |

*Primary Examiner*—Patrick J. Ryan
*Assistant Examiner*—J. M. Gray
*Attorney, Agent, or Firm*—Austin R. Miller

[57] ABSTRACT

Disclosed is a carbon fiber made from an acrylic fiber, the carbon crystal of which has a crystal size Lc of 15 to 65 Å as determined by the wide angle X-ray diffractometry. This carbon fiber has regions with a lower crystallinity in the surface layer portion thereof than that of the central portion thereof, and the compressive strength $\sigma_{cf}$(GPa) of the single filament thereof determined by the loop method satisfies formula (I):

$$\sigma_{cf} \geqq 10.78 - 0.1176 \times Lc \quad \text{(I)}.$$

The carbon fiber is produced by ionizing in vacuo an atom or molecule which is solid or gaseous at normal temperature, accelerating the ionized atom or molecule by an electric field, and implanting the accelerated ionized atom or molecule in a bundle of carbon fibers.

9 Claims, 7 Drawing Sheets

CARBON FIBER MADE FROM ACRYLIC FIBER AND PROCESS FOR PRODUCTION THEREOF

This application is a continuation of application Ser. No. 07/456,317, filed Dec. 26, 1989, now abandoned.

BACKGROUND OF THE INVENTION

1. Field of the Invention

The present invention relates to a carbon fiber and a process for producing the same. More particularly, it relates to a carbon fiber made from an acrylic fiber having an excellent compressive strength, and a process for the production of this carbon fiber.

2. Description of the Related Art

With the recent increase in the use of carbon fibers, the requirements for carbon fibers have become very strict. The main requirement has been directed to the tensile characteristics, and therefore, the tensile strength has been greatly increased. Nevertheless, the compressive strength is little improved, and therefore, the problem of suppression of increase of practical characteristics, such as flexural strength, due to the low compressive strength has become serious. In a graphite fiber having an elastic modulus of at least 390 GPa, formed by heat treatment at a high temperature, i.e., having a large crystal size Lc, the compressive strength of a single filament is about 3.5 GPa. This value is as low as about ½ of the compressive strength (7 GPa) of a single filament of a carbon fiber having an elastic modulus of 245 GPa. This is a serious problem.

Many proposals have been made for techniques of improving the tensile characteristics, but very few proposals have been made for techniques of improving the compressive strength.

A graphite fiber having a high compressive strength and a high elastic modulus of at least 340 GPa has been proposed, which is formed by specifying the spinning and heat-treating conditions (Japanese Unexamined Patent Publication No. 63-211326).

A chemical oxidization treatment of a carbon fiber with a hot concentrated inorganic acid such as sulfuric acid, nitric acid or phosphoric acid, or an electrochemical oxidation treatment of a carbon fiber in an aqueous solution of an electrolyte containing a nitric acid ion and a subsequent inactivating treatment has been proposed (Japanese Unexamined Patent Publication No. 58-214527 and Japanese Unexamined Patent Publication No. 61-225330) as a technique for reducing the crystallinity of the surface layer. Each of these proposals effectively improves the tensile strength, but does not greatly improve the compressive strength. Further, in the above-mentioned treatments, an excessive amount of oxygen-containing functional groups are formed in the surface layer of the carbon fiber, and since the functional groups are removed by the treatment, an inactivating treatment, which costly, must be carried out.

The technique of accelerating an ionized atom or molecule and implanting the same in the surface of a material, i.e., the ion-implanting method, has been examined as a technique for modifying the structure of the surface layer portion, mainly in the field of semiconductors (Japanese Unexamined Patent Publication No. 58-87818 and Japanese Unexamined Patent Publication No. 58-87894).

It also has been proposed to implant an ionized atom or molecule in a carbon material (Japanese Unexamined Patent Publication No. 62-235280).

In connection with the ion implantation into a carbon fiber, an ion implantation in a vapor-phase grown carbon fiber was reported (TANSO, No. 104, page 2, 1984), but in the case of a carbon fiber having a high anisotropy, such as a vapor-phase grown carbon fiber, is subjected to the ion implantation treatment, a noticeable improvement of the compressive characteristics, as obtained in an acrylic carbon fiber, cannot be obtained.

SUMMARY OF THE INVENTION

Therefore, the primary object of the present invention is to provide a carbon fiber having a high compressive strength not obtainable by conventional techniques, and a process for the production of this carbon fiber.

In one aspect of the present invention, there is provided a carbon fiber made from an acrylic fiber, having a crystal size Lc of 15 to 65 angstroms as determined by wide angle X-ray diffractometry, and having regions with a lower crystallinity in the surface layer portion thereof than that of the central portion thereof and whose compressive strength ($\sigma_{cf}$) of the single filament determined by the loop method satisfies the following formula (I):

$$\sigma_{cf} \geqq 10.78 - 0.1176 \times Lc \quad \text{(I).}$$

In another aspect of the present invention, there is provided a carbon fiber made from an acrylic fiber, having a $\nu a/\nu b$ ratio of at least 1.5 where $\nu a$ is a half width of the scattering peak at 1320 to 1380 cm$^{-}$of the laser Raman spectrum of at least part of the regions in the surface layer portion of the single filament and $\nu b$ is a half width of the scattering peak at 1320 to 1380 cm$^{-1}$ of the laser Raman spectrum of the central portion of the single filament.

In another aspect of the present invention, there is provided a process for the production of a carbon fiber made from an acrylic fiber, which comprises ionizing in vacuo an atom or molecule which is solid or gaseous at normal temperature, accelerating the ionized atom or molecule by an electric field, and implanting the accelerated ionized atom or molecule in a carbon fiber through the surface thereof.

BRIEF DESCRIPTION OF THE DRAWINGS

FIGS. 1, 2 and 3 illustrate distribution of crystallinity in the depth direction from the surface of a graphite fiber implanted with $10^{16}/cm^2$ of boron ions as determined by the laser Raman spectroscopy, in which FIG. 1 shows the results of the peak division of the Raman spectrum of the surface layer portion of the ion-implanted fiber by three Gaussian functions, FIG. 2 shows the results of the peak division of the Raman spectrum of the central portion of the ion-implanted fiber by four Lorenz functions, and FIG. 3 is a diagram in which the half width of the peak in the region of 1320 to 1380 cm$^{-1}$ is plotted relative to the depth from the surface of the fiber;

FIGS. 4, 5 and 6 illustrate distribution of crystallinity on a graphite fiber surface determined by laser Raman spectroscopy, in which FIG. 4 shows the results of the peak division of the Raman spectrum of the modified graphitized fiber implanted with $10^{16}/cm^2$ of boron ions by three Gaussian functions, FIG. 5 shows the results of the peak division of the Raman spectrum of the modified graphite fiber implanted with $10^{15}/cm^2$ of boron ions by three Gaussian functions, and FIG. 6 shows the results of the peak division of the Raman spectrum of the graphite fiber before the implantation with boron ions by four Gaussian functions;

FIGS. 7 and 8 are diagrams illustrating a method of measuring the compressive strength of the single filament by the loop method, in which FIG. 7 shows the method of measuring the minor axis (D) and major axis ($\phi$) of the loop, and FIG. 8 is a diagram in which the strain $\epsilon$ g is plotted on the abscissa and the major axis/minor axis ratio ($\phi$/D) is plotted on the ordinate;

DESCRIPTION OF THE PREFERRED EMBODIMENTS

Figure 1:
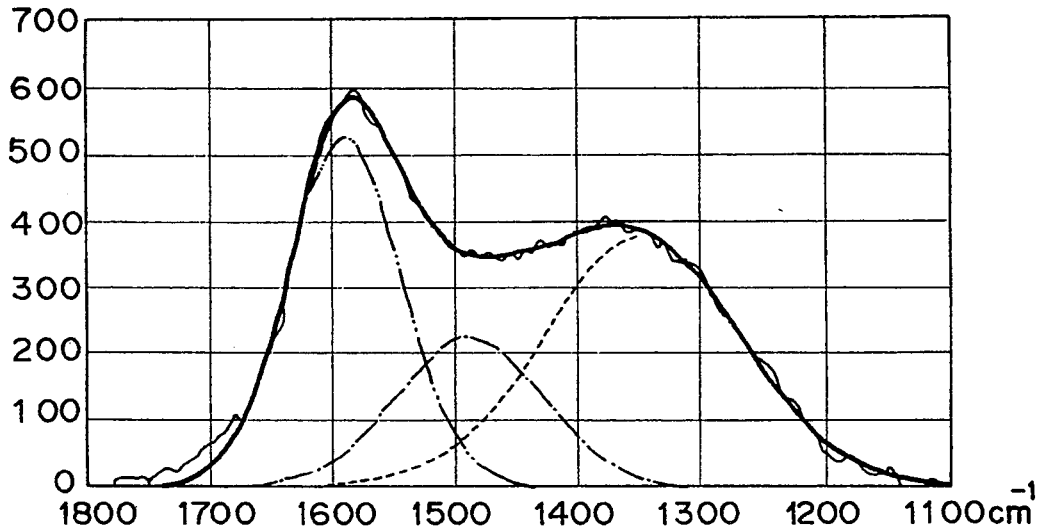
Figure 2:
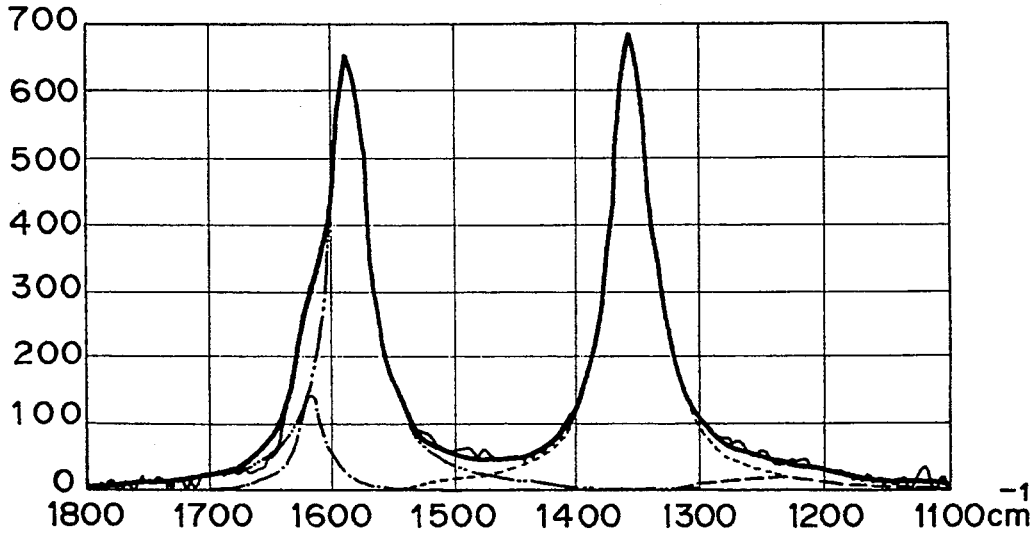

In the present invention, by the surface layer portion of the fiber is meant a region which is within the region spanning from the surface of the single filament to the depth corresponding to a half of the radius thereof and which spans from the surface to a depth of 2.0 $\mu$m, provided that the surface of the single filament is excluded from the surface layer portion. By the central portion of the fiber is meant the region within 0.3 $\mu$m from the center of the single filament.

The crystallinity is determined by the laser Raman spectroscopy described hereinafter. The crystallinity is a characteristic determined by the size of the crystal constituting the carbon fiber and the orientation of the carbon crystal arrangement. When the size of the crystal is large and the orientation of the carbon crystal arrangement is high, the crystallinity is considered high.

The fact that in the present invention, the crystallinity of the surface layer portion is lower than the crystallinity of the central portion means that in the analysis of the crystallinity of the section of the single filament by the laser Raman spectroscopy described hereinafter, the ratio ($\nu a/\nu b$) of the half width ($\nu a$) of the scattering peak in the region of 1320 to 1380 $cm^{-1}$ (which region is hereinafter referred to "the vicinity of 1350 $cm^{-1}$") of the Raman spectrum of the surface layer portion to the half height width ($\nu b$) of the scattering peak in the vicinity of 1350 $cm^{-1}$ of the Raman spectrum of the central portion of the fiber exceeds 1.0.

The carbon fiber of the present invention has regions that have a lower crystallinity in the surface layer portion thereof than that of the central portion defined as above.

The process for the production of the high-performance carbon fiber of the present invention will now be described. As the acrylic polymer constituting an acrylic fiber (precursor) as the starting material of the carbon fiber, there can be mentioned a copolymer comprising at least 90 mole% of acrylonitrile and less than 10 mole% of a copolymerizable vinyl monomer, for example, acrylic acid, methacrylic acid or itaconic acid, an alkali metal salt, an ammonium salt or a lower alkyl ester thereof, acrylamide or a derivative thereof, or allylsulfonic acid or methallysulfonic acid or a salt or alkyl ester thereof.

Any known solution polymerization, suspension polymerization, and emulsion polymerization process can be adopted as the polymerization process. The degree of polymerization is such that the intrinsic viscosity ([$\eta$]) is preferably at least 1.2, more preferably at least 1.7. In general, the intrinsic viscosity [$\eta$] should be not more than 5.0 in view of the spinning stability.

The wet spinning method, dry jet wet spinning method, and dry spinning method can be adopted as the spinning method, although the dry jet wet spinning method is most preferably adopted because a dense precursor is obtained thereby.

The use of a precursor having a high density is effective for obtaining a carbon fiber having high compression characteristics. More specifically, a dense precursor having a $\Delta L$ value not larger than 45, preferably not larger than 30, most preferably not larger than 10, as determined by the iodine adsorption method, is generally used. In general, it is difficult to obtain a $\Delta L$ value of smaller than 5.

As the means for obtaining a dense precursor having a $\Delta L$ value not larger than 45, there is effectively adopted a method in which the degree of swelling of a coagulated fiber is kept at a low level by increasing the polymer concentration in the spinning solution, lowering the temperatures of the spinning solution and coagulating solution, and reducing the tension at the coagulation. The degree of swelling of a drawn yarn is kept at a low level by selecting the optimum conditions for the number of drawing stages in the bath drawing, the draw ratio, and the drawing temperature.

The fineness of a single precursor filament is preferably not larger than 2.0 denier, more preferably not larger than 1.5 denier, and most preferably not larger than 1.0 denier. In general, it is difficult to prepare a filament having a fineness of smaller than about 0.1 denier.

As the oxidizing treatment of the precursor, there is preferably adopted a method in which the precursor is heated at 240° to 300° C. in an oxidizing atmosphere under tension or drawing, so that the density is increased to at least 1.25 g/$cm^3$, more preferably at least 1.30 g/$cm^3$. In general, a density of not larger than 1.6 g/$cm^3$ is adopted in view of the physical properties. Any known oxidizing atmospheres such as air, oxygen, nitrogen dioxide, and hydrogen chloride can be used, but air is preferable from the viewpoint of economy.

The obtained oxidized fiber is carbonized at a temperature of at least 1,000° C., but lower than 2,000° C. in an inert atmosphere, and is then graphitized at a temperature of at least 2,000° C. according to need. To obtain a dense carbon fiber having few internal defects such as voids, preferably, in the temperature regions of from 350° to 500° C. and from 1,000° to 1,200° C., the temperature-elevating rate is preferably not higher than 500° C./min, more preferably not higher than 300° C./min, most preferably not higher than 150° C./min. The minimum permissible temperature-elevating rate is about 10° C./min in view of productivity. To improve the density, preferably a method is adopted in which, in the temperature region of from 350° to 500° C. or at a temperature of at least 2,300° C., the calcination is preferably carried out under a drawing of at least 1%, more preferably at least 5%, most preferably at least 10%. A drawing exceeding 40% is not preferable because fuzz is undesirably formed.

At the calcination treatment, a mixed atmosphere with an active atmosphere such as hydrogen chloride can be adopted in the temperature region of from 300° C. to 1,500° C.

The acrylic carbon fiber of the present invention can be obtained by implanting the surface of the obtained carbon fiber with an accelerated atom or molecule.

The most preferable method of forming an accelerated atom or molecule and implanting the atom or molecule into the carbon fiber from the surface thereof is the ion-implanting method, comprising ionizing an atom or molecule in vacuo and accelerating the ionized atom or molecule by an electric field. According to this method, by increasing the intensity of the electric field, an atom or molecule having an energy proportional to the intensity of the electric field can be obtained, and therefore, the atom or molecule can be implanted to a desired depth. The accelerated atom or molecule collides with the carbon atom constituting the carbon fiber to impart the kinetic energy of the atom or molecule to the carbon atom, whereby implantation damage occurs in the carbon fiber. Since such implantation damage is accumulative, a layer having a low crystallinity, i.e., a substantially isotropic layer, is formed in the surface layer portion of the carbon fiber.

When the graphitized carbon fiber is subjected to the ion-implanting treatment, the graphite in the surface layer of the single filament is modified to form a substantially isotropic structure resembling a diamond-like carbon film structure.

Namely, the carbon fiber structure of the present invention is characterized in that the surface layer portion is substantially isotropic. As the means for rendering the surface layer portion substantially isotropic, a method can be adopted in which the surface layer portion having a high crystallinity is damaged, to render is substantially isotropic, and/or a method in which the surface layer is modified so that a crystal structure resembling that of diamond is produced.

When the graphitized fiber is examined by the laser Raman spectroscopy, two peaks are observed in the region of 1550 to 1610 $cm^{-1}$ (which region is hereinafter referred to "the vicinity of 1580 $cm^{-1}$") and in the vicinity of 1350 $cm^{-1}$. It is considered that the peak in the vicinity of 1580 $cm^{-1}$ corresponds to the complete graphite crystal, and as the amount of a graphite crystal having a disturbed structure increases, the peak intensity ratio and the half width of the peak in the vicinity of 1360 $cm^{-1}$ are enhanced. By the peak intensity ratio is meant a ratio of the peak intensity at 1350 $cm^{-1}$ to the peak intensity at 1580 $cm^{-1}$.

A graphite fiber having an elastic modulus of at least 340 GPa is obtained by graphitizing the carbon fiber to a structure having a carbon content, as determined by the elementary analysis, of at least 98%, a carbon crystal size Lc, as determined by the wide angle X-ray diffractometry, of at least 22 angstroms, and an orientation degree of at least 85% in the fiber axis direction. When this graphite fiber is analyzed by laser Raman spectroscopy, two relatively sharp peaks are observed in the vicinity of 1580 $cm^{-1}$ and in the vicinity of 1350 $cm^{-1}$.

The inventors found that, if ions of boron or the like are implanted under a high vacuum and high acceleration voltage into the above-mentioned graphite fiber, the single filament tensile strength and single filament compressive strength of the graphite fiber can be greatly improved. It also was found that, when the ion-implanted graphite fiber is analyzed by the laser Raman spectroscopy, a spectrum resembling that of the above-mentioned diamond-type carbon film is obtained.

The inventors carried out research into the relationships between changes of the laser Raman spectrum and the degrees of improvement of the single filament tensile strength and single filament compressive strength. More specifically, if the peak division of the obtained Raman spectrum is performed by curve fitting by using a Gaussian functional profile, a peak is observed in the range of from 1400 to 1500 $cm^{-1}$ in addition to the peak in the vicinity of 1580 $cm^{-1}$ and the peak in the vicinity of 1350 $cm^{-1}$. As the peak intensity ratio of this peak in the range of from 1400 to 1500 $cm^{-1}$ to the peak in the vicinity of 1580 $cm^{-1}$ is high, the proportion of the structure resembling that of the diamond-like carbon film is increased, and the desired high compressive strength and tensile strength of the single filament can be preferably obtained if the peak intensity ratio is at least 0.3. A more preferable peak intensity ratio is at least 0.5. In general, it is difficult to obtain a peak intensity ratio exceeding 1.5.

The larger the peak intensity ratio, the more prominent the improvement in the single filament tensile strength and single filament compressive strength. When the peak intensity ratio is at least 0.3, the carbon fiber made from an acrylic fiber is preferable, because this carbon fiber is characterized in that the tensile modulus of elasticity of the single filament is at least 340 GPa, the tensile strength of the single filament is at least 3.9 GPa, and the compressive strength $\sigma_{cf}$ of the single filament is at least 4.9 GPa.

In contrast, in a diamond-type carbon film, an asymmetric peak having a shoulder in the region of 1350 to 1450 $cm^{-1}$ is observed, with the region of 1500 to 1600 $cm^{-1}$ as the center.

As the ion to be implanted in the ion-implanting method, there can be mentioned elements which are solid at room temperature, such as, for example, beryllium, boron, carbon silicon, phosphorus, titanium, chromium, iron, nickel, cobalt, copper, zinc, germanium, silver, tin, molybdenum, tellurium, tantalum, tungsten, gold, and platinum; elements which are gaseous at normal temperature, such as hydrogen, nitrogen, neon, argon, krypton, fluorine, and chlorine; and molecular ions formed of these elements, such as boron fluoride. From the economical viewpoint and in view of the effect of improving the compressive characteristics by the implantation, nitrogen, boron, argon, carbon silicon, titanium, chromium, nickel and copper are preferable, and nitrogen, boron, carbon titanium and chromium are most preferable. A simultaneous or continuous implantation of at least two kinds of ion seeds effectively improves the treatment effect.

Optimum implanting conditions such as the ion seed, acceleration voltage, and implantation quantity suitable for obtaining a desired structure, are selected while taking into consideration the relationship to the carbon fiber as the target.

To effectively perform the ion implantation the vacuum degree at the implanting is preferably not larger than $10^{-3}$ Torr, more preferably not larger than $10^{-4}$ Torr, and most preferably not larger than $10^{-5}$ Torr.

The ion acceleration voltage is preferably at least 50 kV, more preferably at least 100 kV, and most preferably at least 150 kV. Since the implantation depth is determined by the combination of the ion seed and acceleration voltage, an optimum combination of the ion seed and acceleration voltage must be determined, to obtain a desired implantation depth.

The implantation quantity is preferably at least $10^{15}$ ions/cm$^2$, more preferably at least $10^{16}$/cm$^2$, and most preferably at least $10^{17}$/cm$^2$, and an optimum implantation quantity is determined by the combination of the ion seed and acceleration voltage.

The implantation time depends on the implantation quantity and the beam intensity of the implantation apparatus. To maintain an implantation quantity of at least $10^{15}$/cm$^2$ at a high productivity, the beam intensity is preferably at least 0.1 $\mu$A/cm$^2$, more preferably at least 1 $\mu$A/cm$^2$, and most preferably at least 5 $\mu$A/cm$^2$. The implantation can be carried out at a beam intensity of at least 1 $\mu$A/cm$^2$, for less than 10 minutes, preferably less than 1 minute.

When feeding the carbon fiber for the implantation, the width of fiber bundle is preferably spread to disperse single filaments, so that the thickness of the fiber bundle in the ion-implantation direction is 1 to 5 times, preferably 1 to 3 times, and most preferably 1 to 2 times, the diameter of the single filament.

As the spreading method, a method can be adopted in which single filaments are separated and fixed to a metal frame, but preferably, a method is adopted in which a carbon fiber bundle is spread by an expanding guide to which a mechanical vibration such as an ultrasonic vibration or low frequency vibration is given. A flat guide or a convex guide is preferably used in combination with the expanding guide. If this method is adopted, a carbon fiber can be continuously supplied, and thus the method is advantageous from the viewpoint of productivity. When a carbon fiber is continuously supplied, the fiber is moved preferably at a constant moving speed.

An implantation to the back side is difficult, even when single filaments are dispersed, and accordingly, the implantation is preferably effected by at least two implantations from different directions as a whole, for example, one from the front side and one from the back side. The implantations from different sides can be carried out simultaneously or one after the other. Different ion seeds can be used in these implantations.

In the crystal structure of the carbon fiber obtained by the ion implantation, the crystallinity of the ion-implanted surface layer portion is lower than that of the central portion of the fiber, but the crystallinity of the unimplanted central portion is not changed, and therefore, the ion-implanted carbon fiber is characterized by having a clearly stepped crystal structure. The distribution of the crystallinity should be such that, in the above-mentioned laser Raman spectroscopy of the section of the single filament, the ratio ($\nu a/\nu b$) of the half width ($\nu a$) of the scattering peak in the vicinity of 1350 cm$^{-1}$ of the Raman spectrum of the surface layer portion of the single filament to the half width ($\nu b$) of the scattering peak in the vicinity of 1350 cm$^{-1}$ in the Raman spectrum of the central portion of the single filament is preferably at least 1.5, more preferably at least 2.0, and most preferably at least 3.0, to obtain the desired improvement of the compressive strength. In general, it is difficult to obtain a $\nu a/\nu b$ ratio of 10 or more. The larger the $\nu a/\nu b$ ratio value, the lower the crystallinity, and thus, the lower the crystallinity of the region in the surface layer portion.

If an atom or molecule which is solid at room temperature is implanted, the surface layer portion of the carbon fiber has a structure in which the implanted element is dispersed in the form of the atom or molecule, and this dispersion state can be determined by the secondary ion mass spectroscopy (SIMS). This dispersion state is such that a maximum concentration region is present in the surface layer portion located about 0.1 to about 1 $\mu$m inside from the surface of the single filament, rather than on the surface thereof, and a distribution close to the normal distribution is manifested.

The carbon fiber of the present invention is characterized in one aspect thereof by the specified distribution of crystallinity and the distribution of the element implanted therein, which are determined by the SIMS and the elementary analysis. By the implanted element used herein is meant an element other than carbon. Preferably, the carbon fiber of the present invention does not contain any appreciable amount of an implanted element in the central portion of the single filament, and the content of the implanted element is highest in the surface layer portion thereof and the content of the implanted element on the surface thereof is lower than the highest content in the surface layer portion thereof.

The content of the implanted element on the surface of the single filament is preferably not more than $\frac{1}{2}$, more preferably not more than 1/5, of the highest content in the surface layer portion, in view of the enhanced adhesion to matrix resin.

By the phrase "does not contain any appreciable amount of an implanted element" used herein is meant that the concentration of implanted element is less than 0.05% in atomic ratio as determined by SIMS. However, where the implanted element is nitrogen, the above phrase means that the difference in the concentrations of nitrogen as measured before and after implantation is negligibly small.

The crystallinity by the laser Raman spectroscopy, the tensile strength, elastic modulus and compressive strength of a single filament, the crystal size, the degree of orientation and other properties are determined as follows.

(1) Distribution of Crystallinity in Depth Direction of a Carbon Fiber

A single filament is electrolessly plated with copper and embedded in an epoxy resin, and the section of the single filament is polished so that the inclination angle to the fiber axis is about 5°. The polished sample is subjected to analysis, and if the inclination angle is larger than 10°, the polished face of the section of the single filament is considered small, and the number of measurement points as decreased and precision is reduced by the analysis conducted at a beam diameter of 1 $\mu$m.

A Ramanor U-1000 Raman system supplied by Jobin-Yvon, France, is used as the measurement apparatus. Using an argon ion laser (beam diameter = 1 $\mu$m) having an excitation wavelength of 5145 Å, the Raman spectrum is measured at intervals of about 1 $\mu$m toward the central portion from the surface of the carbon fiber. With respect to each Raman spectrum, the peak division is carried out by curve fitting using a Ganssian function profile. When the peak division cannot be carried out by this method, Lorenz function profile is available. The distribution of half width in the vicinity of 1350 cm$^{-1}$ is analyzed in the depth direction of a single filament.

(2) Crystallinity on Surface of Carbon Fiber by Laser Raman Spectroscopy

One single filament is collected from a sample fiber bundle and is subjected to analysis. A Ramanor U-1000 microscopic Raman system supplied by Jobin-Yvon, France, is used as the measurement apparatus. Using an argon ion laser (beam diameter = 1 μm) having an excitation wavelength of 5145 Å, the Raman spectrum of the surface of the sample filament is measured, and with respect to each Raman spectrum, the peak division is carried out by curve fitting using a Gaussian functional profile, and the ratio of the intensity of the peak (peak height) observed within a range of 1400 to 1500 $cm^{-1}$ to the intensity of the peak (peak height) observed in the vicinity of 1580 $cm^{-1}$ is determined. When the peak division cannot be carried out by curve fitting using a Gaussian functional profile, for example, in the case of a non-ion-implanted graphite fiber, the peak division is carried out by curve fitting using a Lorenz functional profile.

(3) Tensile Strength and Elastic Modulus of Single Filament

The tensile strength and elastic modulus are determined by the single filament test method of JIS R-7601. The length of the sample single filament is set at 25 mm, and for one sample, 50 single filaments are measured and the mean value is calculated. The average single filament sectional area determined from the fineness and density of the sample fiber bundle, and the number of constituent single filaments, is used as the sectional area of the single filament.

(4) Compressive Strength ($\sigma_{cf}$) of Single Filament

Figure 7:
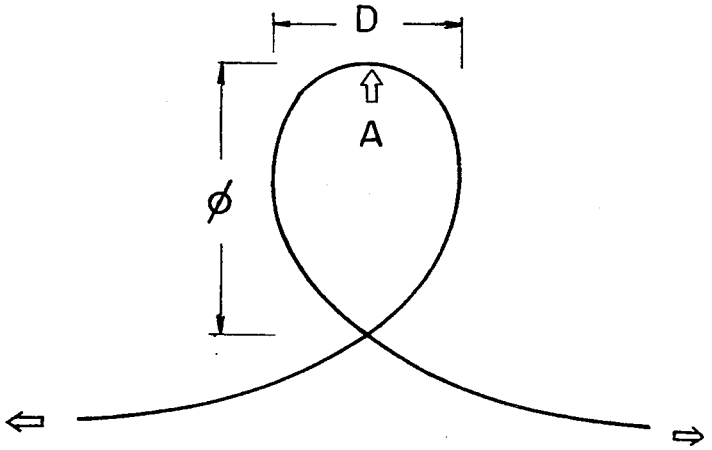
Figure 8:
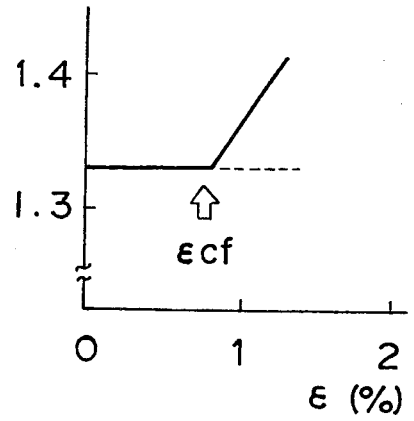

A single filament having a length of about 10 cm is placed on a slide glass, one or two drops of glycerol are allowed to fall on the central portion, a loop is formed by twisting the single filament, and a preparate is placed on the loop. Then the assembly is placed under a microscope and projected on a monitor (CTR) by a video camera connected to the microscope. While the loop is within the visual field, the loop is pulled at a constant speed with both ends pressed by the fingers, to impose a strain on the loop. The behavior thereof is recorded by video until the single filament is broken. Stopping the recorded image, the short diameter (D) and long diameter ($\phi$) of the loop are measured on the CRT. The strain ($\epsilon$) at point A in FIG. 7 is calculated from the diameter (d) of the single filament and D according to the formula of $\epsilon = 1.07 \times d/D$, and $\epsilon$ is plotted on the abscissa and the long diameter/short diameter ratio ($\phi$/D) is plotted on the ordinate (FIG. 8).

The $\phi$/D ratio shows a certain value (about 1.34) in the region where compression buckling does not occur, but this value is greatly increased after compression buckling occurs. The strain at which $\phi$/D begins to greatly increase from the certain value corresponds to the strain at which the compression buckling occurs. This strain is determined as the compression yield strain ($\epsilon$cf). The measurement is conducted for about 10 single filaments, and the mean value is calculated. The compressive strength of the single filament is determined by multiplying the obtained mean value by the tensile modulus of elasticity.

The tensile modulus of elasticity is determined by impregnating the carbon fiber bundle with Bakelite ERL-4221/boron trifluoride monoethylamine ($BF_3$.MEA)/acetone (weight ratio = 100/3/4), heating the resin-impregnated strand at 130° C. for 30 minutes to effect curing, and carrying out the measurement by the resin-impregnated strand test method of JIS R-7601.

(5) Elementary Analysis

Using CHN Corder Model MT-3 supplied by Yanagimoto Seisakusho, the carbon content is determined by the ratio of the carbon weight to the sample weight. The water content in sample is determined and the sample weight is corrected from the water content.

(6) Crystal Size Lc

The fiber bundle is cut to a length of 40 mm, 20 mg of the cut fiber is precisely weighed and collected, and the filaments are arranged so that the axes are precisely parallel to one another. By using a sample-preparing tool, a uniform sample fiber bundle having a width of 1 mm is formed and impregnated with a dilute collodion solution, so that the fiber bundle is fixed and is not deformed. Then the fiber bundle is fixed to a sample stand for wide angle X-ray diffractometry. An X-ray generator supplied by Rigaku Denki is used as the X-ray source, and a CuK$\alpha$ ray (Ni filter is used) having an output of 35 kV-15 mA is also used. By using a goniometer supplied by Rigaku Denki, the diffraction peak in the vicinity of 2$\theta$-26°, which corresponds to the plane index (002) of graphite, is detected by the permeation method by a scintillation counter.

The crystal size Lc is determined from the half width in the diffraction peak, according to the following formula:

$$Lc = \lambda / \beta_O \cos\theta$$

wherein $\lambda$ is the wavelength (Å) of the used X-ray (since CuK$\alpha$ is used, $\lambda$ is 1.5418 Å), $\beta_O$ is determined by $\beta_O^2 = \beta_E^2 - \beta_I^2$ (in which $\beta_E$ is the measured apparent half width and $\beta_I$ is the apparatus constant which is $1.05 \times 10^{-2}$ rad in this case), and $\theta$ is Bragg's diffraction angle.

(7) Orientation Degree $\pi_{002}$ in Direction of Fiber Axis

The crystal orientation degree is calculated from the half width (H°) of the expansion of the profile in the meridional direction including the maximum intensity of the (002) diffraction, according to the following formula:

$$\text{Crystal orientation degree } (\pi_{002})(\%) = \frac{180° - H°}{180°} \times 100$$

The torsional modulus of elasticity, ΔL, the element distribution by SIMS and the 0° compressive strength of a composite are determined by the following methods.

(8) Torsional Modulus of Elasticity (Gf)

Figure 9:
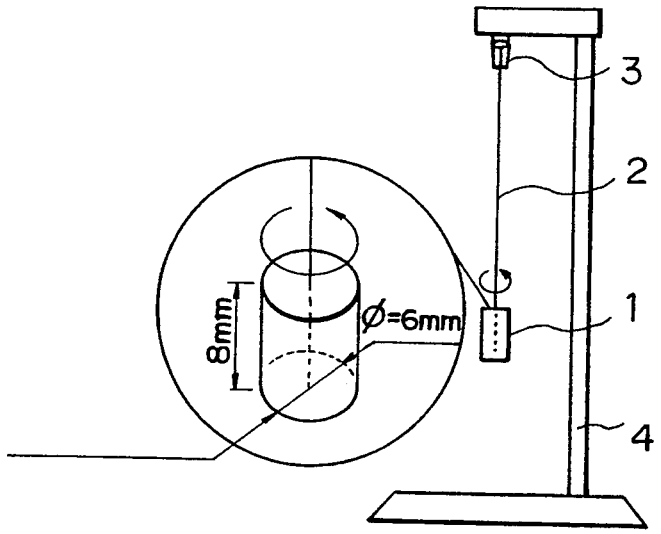
FIG. 9 is a diagram illustrating a method of measuring the torsional modulus of elasticity.
Figure 10:
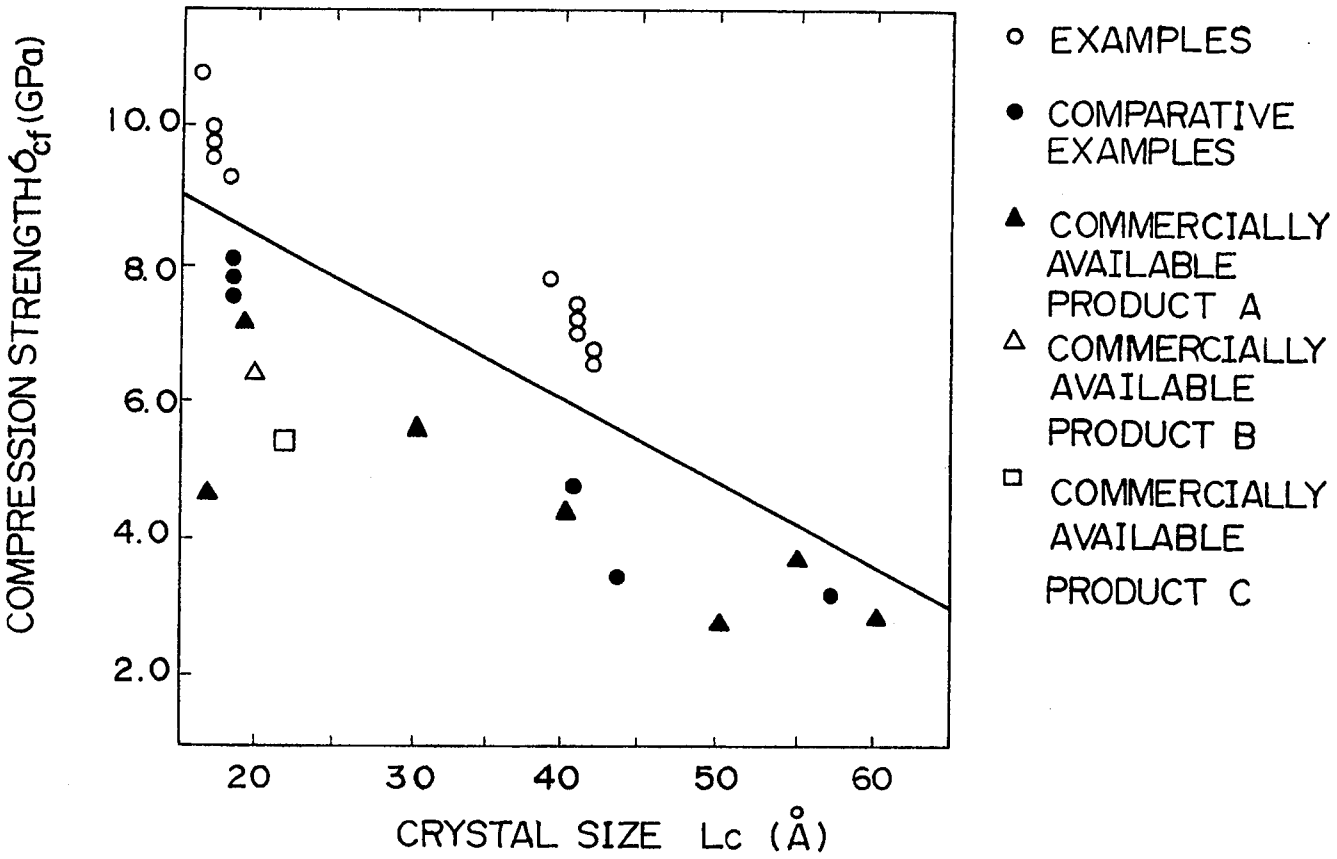
FIG. 10 is a diagram illustrating the relationship between the crystal size Lc and the compressive strength of the single filament, observed in the examples and comparative examples, and illustrating the results of the measurement of conventional commercially available carbon fibers as reference data; and, FIG. 11 illustrates distribution of the implanted elements in the depth direction from the surface of the fiber as determined by the secondary ion mass spectrometry (SIMS), wherein the abscissa indicates the depth from the surface and the ordinate the secondary ion intensity of boron ions.

As illustrated in FIG. 9, one end of a single filament (2) having a length of about 10 cm is inserted into a fine hole formed at the center of a glass weight (1) having a weight of about 0.5 g, a length of 8 mm and a diameter of 6 mm, and is bonded by an instant adhesive, and the other end is fixed by a clip (3) through a cushion paper and allowed to hang down on a frame (4) of a stand. The weight (1) is twisted by about +10 turns to impart torsions to the single filament, and then the weight is freed. The time required for the weight to reversely rotate by about −10 turns, and to stop and to further rotate by about +10 turns to the original torsion state and stop, is designated as one frequency T (sec), and the measurement is continuously made for 5 frequencies to determine a mean value thereof. This measurement is conducted for about 5 single filaments, and the mean value is calculated, and the torsional modulus of elasticity Gf (GPa) is determined according to the following formulae:

$Gf=125\pi lI/(d^4T^2)\times 10^{-5}$ and $I=MD^2/(8\ g)$ wherein l represents the length (mm) of the fiber, d represents the diameter (mm) of the single filament, M represents the weight (g) of the weight, D represents the diameter (mm) of the weight, g represents the acceleration (m/sec$^2$) of the gravity, and I represents the torsional moment.

(9) ΔL by Iodine Adsorption Method

About 0.5 g of a dry sample having a fiber length of 5 to 7 cm is precisely weighed and charged in a plugged Erlenmeyer flask having an inner volume of 200 ml. Then, 100 ml of an iodine solution (prepared by charging 51 g of $I_2$, 10 g of 2,4-dichlorophenol, 90 g of acetic acid and 100 g of potassium iodine in a graduated flask having an inner volume of 1 l and dissolving them in water to form a predetermined amount of a solution) is added to the flask. The adsorption treatment is carried out at 60° C. for 50 minutes while shaking. The iodine-adsorbed sample is water-washed for 30 minutes in running water, subjected to centrifugal dehydration at 2000 rpm for 1 minute, and promptly air-dried. The sample is opened and the lightness $L_1$ is measured by a Hunter type color difference meter (Model CM-25 supplied by Color Machine).

Separately, a corresponding sample which has not been subjected to the iodine adsorption treatment is opened, the lightness ($L_0$) is measured by the above-mentioned Hunter type color difference meter, and the lightness difference ΔL is determined from $L_0-L_1$.

(10) Elementary Distribution Analysis by SIMS

A Model A-DIDA 3000 supplied by ATOMIKA, West Germany, is used as the evaluation apparatus. Oxygen ions ($0_2+$) are caused to impinge against the surface of the carbon fiber under a high vacuum of $10^{-9}$ Torr and an acceleration voltage of 12 kV at an ion current of 70 μA, and the secondary ions formed by sputtering are subjected to mass analysis. The sample is prepared by arranging the filaments so that the axes are parallel to one another, and the measurement is carried out in an analysis region having a 120 μm×120 μm size. With regard to the depth, the relationship between the sputtering time and the depth is determined by a surface roughness meter on glassy carbon calcined at 1500° C., and the depth is determined from the thus obtained sputtering rate and the sputtering time.

(11) 0° Compressive Strength of Composite

Carbon filaments are arranged in parallel to one another and impregnated with #3620 resin supplied by Toray to prepare prepregs. The prepregs are laminated, and the determination is carried out with the specimen size and method according to ASTM-D695.

The present invention will now be described in detail with reference to the following examples.

EXAMPLE 1 AND COMPARATIVE EXAMPLE 1

A DMSO solution containing 20% by weight of a copolymer comprising 99.4 mole % of acrylonitrile (AN) and 0.6 mole % of methacrylic acid was prepared. The temperature of the solution was adjusted to 35° C. and the solution was extruded into air through a spinneret with 3,000 orifices, each having a diameter of 0.12 mm, travelled in a space having a length of about 4 mm and coagulated in a 30% aqueous solution of DMSO maintained at a temperature of 5° C. The coagulated fiber was washed with water and drawn at a draw ratio of 3.5 in a three-stage drawing bath, a silicone type oiling agent was applied to the drawn fiber, and the fiber was brought into contact with a roller surface heated at 130° to 160° C. to dry and densify the fiber. The fiber was drawn at a draw ratio of 3 in compressed steam under 3.7 kg/cm$^2$ to obtain a fiber bundle having a single filament fineness of 0.8 denier and a total fineness of 2,400 denier. The ΔL value of the obtained fiber bundle was 28.

The obtained fiber bundle was heated at a draw ratio of 1.05 in air maintained at 240° to 280° C., to obtain an oxidized fiber having a density of 1.35 g/cm$^3$, and then the fiber was carbonized at 1,400° C. in a nitrogen atmosphere, while the fiber was drawn by 8% in a temperature range of 350° to 500° C. at a temperature-elevating rate of 200° C./min. The Lc value of the obtained carbon fiber was 18 Å.

About 100 single filaments of the obtained carbon fiber were divided and fixed on a square aluminum frame having a side of 10 cm, and $1\times10^{16}$/cm$^2$ of boron ions were implanted under a vacuum degree of $3\times10^{-6}$ Torr and an acceleration voltage of 150 kV. This treatment was conducted from both of the front and back surfaces. The beam intensity was 0.2 μA/cm$^2$ and the treatment time was about 20 minutes for each surface.

The Lc value of the ion implanted fiber was 17 Å. The ion-implanted carbon fibers had regions with a lower crystallinity in the surface layer portion than that of the central portion.

With respect to the carbon fiber before or after the ion implantation, the compressive strength of the single filament, the torsional modulus of elasticity, and the tensile properties of the single filament were determined. The results are shown in Table 1.

TABLE 1

| | Ion-implanting conditions | | | Crystal size Lc (Å) | Compressive strength of single filament (GPa) | Torsional modulus of elasticity (GPa) | Tensile properties of single filament | |
|---|---|---|---|---|---|---|---|---|
| | Ion | Acceleration voltage (kV) | Implantation quantity (/cm$^2$) | | | | Strength (GPa) | Modulus of elasticity (GPa) |
| Example 1 | $B^+$ | 150 | $10^{16}$ | 17 | 10.0 | 31.4 | 6.37 | 283 |
| Comparative Example 1 | — | — | — | 18 | 7.55 | 20.6 | 5.39 | 284 |

As seen from Table 1, the compressive strength of of the single fifament was greatly increased from 7.55 GPa to 10.0 GPa, the torsional modulus of elasticity was increased from 20.6 GPa to 31.4 GPa, i.e., by about 1.5 times, and the tensile strength was increased from 5.39 GPa to 6.37 GPa. Thus, the properties desirable for carbon fibers were greatly improved.

EXAMPLES 2 THROUGH 4

The carbon fiber before in implantation obtained in Example 1 was treated in the same manner as described in Example 1 except that the ion-implanting conditions were changed as shown in Table 2. The properties of the obtained ion-implanted carbon fibers are shown in Table 2. The ion-implanted carbon fibers had regions with a lower crystallinity in the surface layer portion than that of the central portion.

TABLE 2

| | Ion-implanting conditions | | | Crystal | Compressive strength | Torsional | Tensile properties of single filament | |
|---|---|---|---|---|---|---|---|---|
| | Ion | Acceleration voltage (kV) | Implantation quantity (/cm$^2$) | size Lc (Å) | of single filament (GPa) | modulus of elasticity (GPa) | Strength (GPa) | Modulus of elasticity (GPa) |
| Example 2 | $B^+$ | 150 | $10^{15}$ | 18 | 9.22 | 29.4 | 6.27 | 284 |
| Example 3 | $B^+$ | 150 | $10^{17}$ | 16 | 10.78 | 32.4 | 6.47 | 282 |
| Example 4 | $Ar^+$ | 150 | $10^{16}$ | 17 | 9.80 | 28.4 | 6.18 | 284 |

EXAMPLE 5

The carbon fiber bundle before ion implantation, as used in Example 1, was spread under an ultrasonic vibration by using convex and flat vibrating guides and an aluminum foil as a lead paper, so that the thickness was 1 to 3 times the diameter of the single filament, and the spread fiber was wound. The fiber wound on a bobbin was set to a vacuum system, the fiber was withdrawn together with the lead paper and wound on another bobbin at a speed of 1 cm/min. Then, nitrogen ions were continuously implanted in the travelling fiber vertically thereto.

The vacuum degree was $1\times10^{-6}$ Torr, the acceleration voltage was 150 kV, and the implantation quantity was $1\times10^{16}$/cm$^2$. The wound carbon fiber was unwound in the opposite direction and the carbon fiber was again similarly treated. Thus, the ion implantation was effected from both the front and back surfaces.

In the obtained carbon fiber, the compressive strength of the single filament was 9.61 GPa, and the obtained carbon fiber was a high-performance carbon fiber substantially comparable to the carbon fiber obtained by batchwise implantation into single filaments (Example 1). The crystal size Lc was 17 Å, i.e., the same as that in Example 1. The ion-implanted carbon fibers had regions with a lower crystallinity in the surface layer portion than that of the central portion.

EXAMPLE 6 AND COMPARATIVE EXAMPLE 2

The carbon fiber bundle before ion implantation, as used in Example 1, was graphitized by elevating the temperature to 2,400° C. Boron ions were implanted into the thus-obtained graphite fiber in the same manner as described in Example 1. The characteristics of the graphite fiber before and after the ion implantation are shown in Table 3.

TABLE 3

| | Ion-implanting conditions | | | Half width of peak at 1350 cm$^{-1}$ | | | Compressive strength | Torsional | Tensile properties of single filament | |
|---|---|---|---|---|---|---|---|---|---|---|
| | Ion | Acceleration voltage (kV) | Implantation quantity (/cm$^2$) | Surface layer portion $\nu a$(cm$^{-1}$) | Central portion $\nu b$(cm$^{-1}$) | $\nu a/\nu b$ | of single filament (GPa) | modulus of elasticity (GPa) | Tensile strength (GPa) | Modulus of elasticity (GPa) |
| Example 6 | $B^+$ | 150 | $10^{16}$ | 190 | 40 | 4.8 | 7.45 | 27.5 | 4.21 | 390 |
| Comparative Example 2 | — | — | — | 40 | 40 | 1.0 | 3.53 | 14.7 | 3.23 | 392 |

As seen from Table 3, in the graphite fiber, the $\nu a/\nu b$ was increased from 1.0 to 4.8, i.e., the crystallinity in the surface layer portion was decreased, the single filament compressive strength $\sigma_{cf}$ was increased from 3.53 GPa to 7.45 GPa, i.e., by about 2 times, the tortional modulus of elasticity was increased from 14.7 GPa to 27.4 GPa, i.e., by almost 2 times, and the tensile strength was increased from 3.23 GPa to 4.21 GPa, by the ion implantation.

Figure 11:
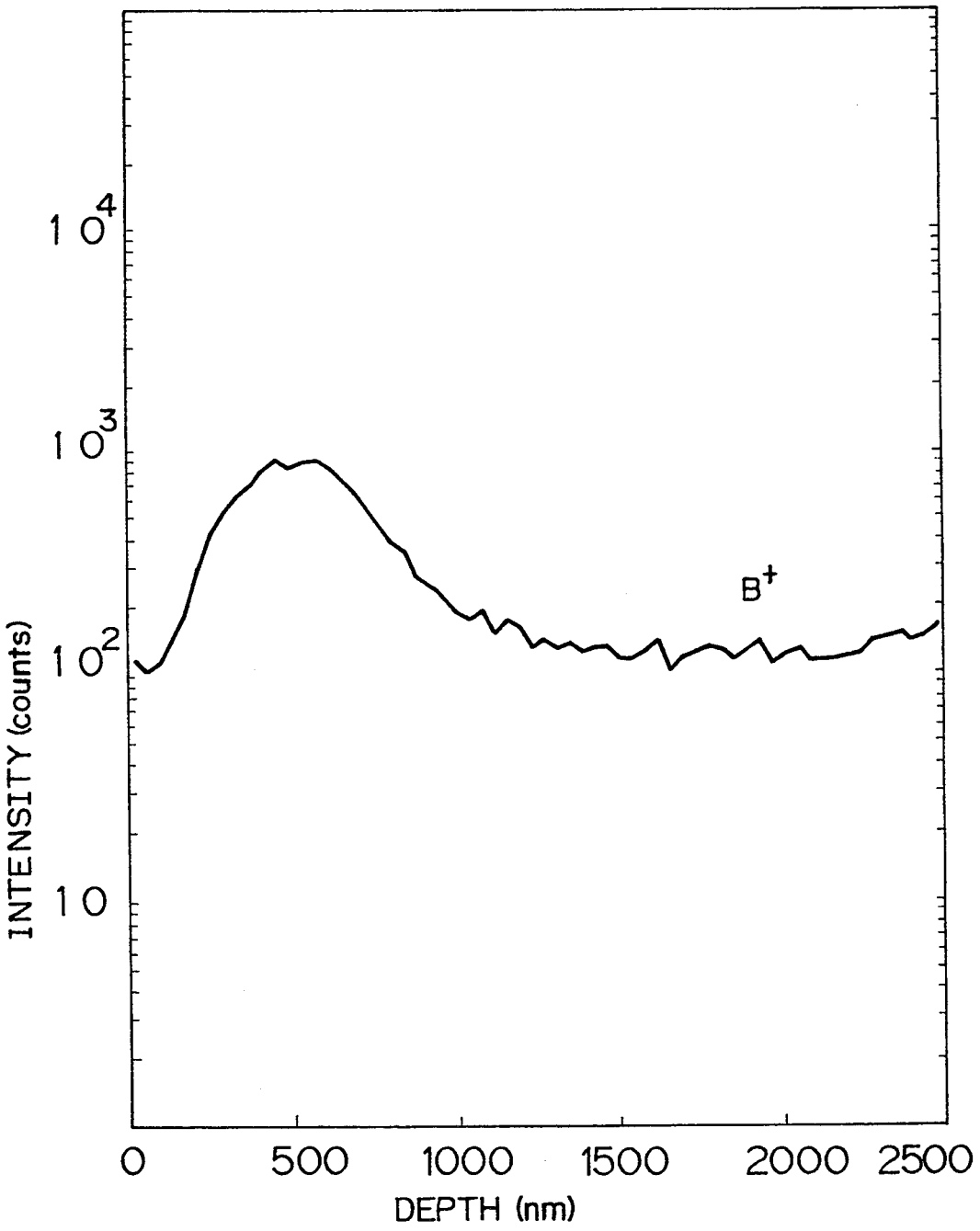

With respect to the ion-implanted carbon fiber, the distribution of boron atoms was analyzed by SIMS. It was found that the boron concentration was highest in a portion about 0.5 μm from the surface. The distribution of boron atoms is illustrated in FIG. 11.

Figure 3:
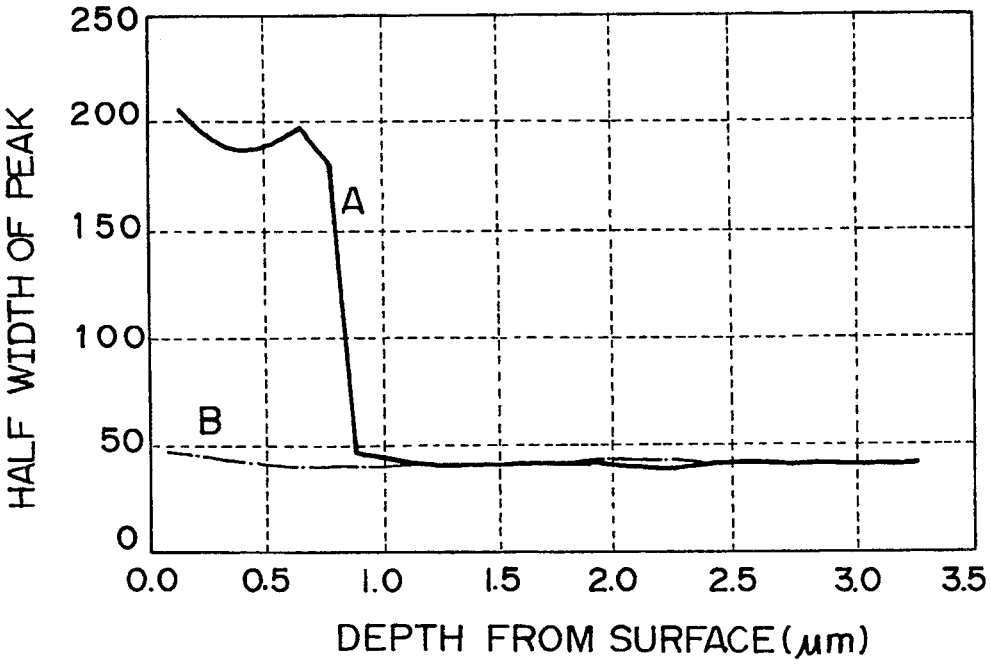
Figure 4:
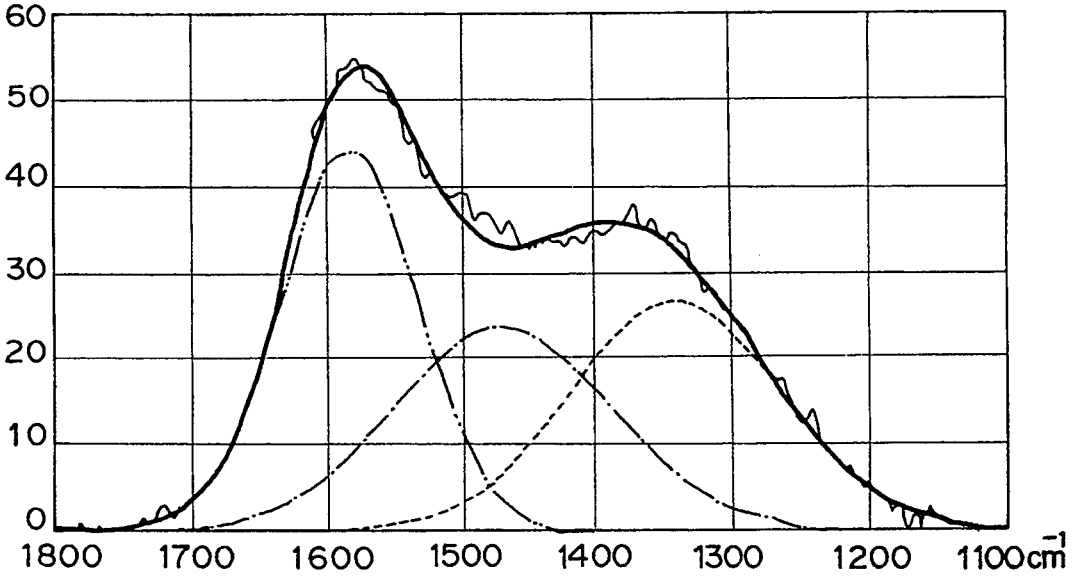
Figure 5:
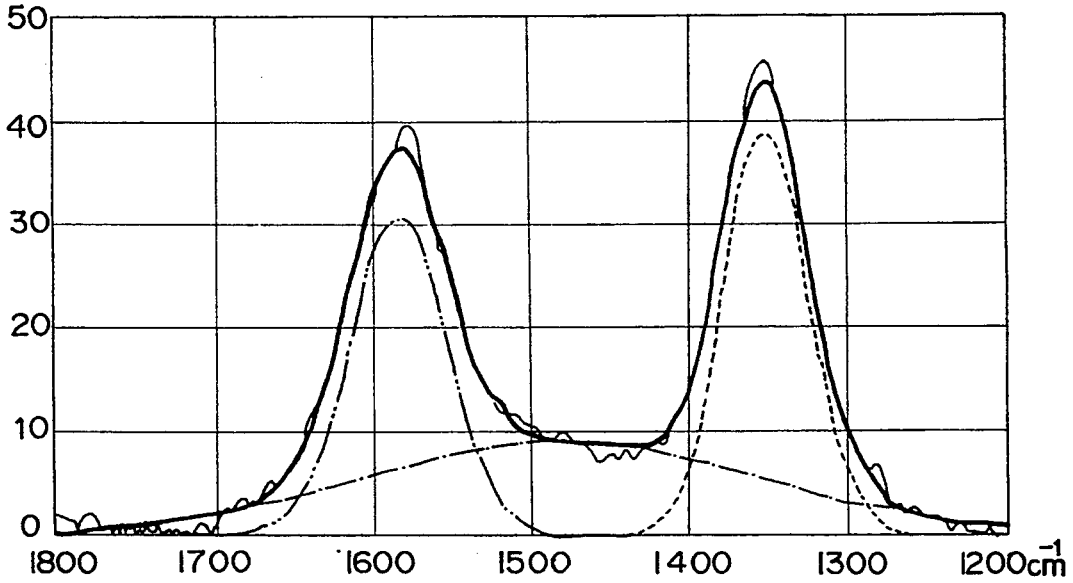
Figure 6:
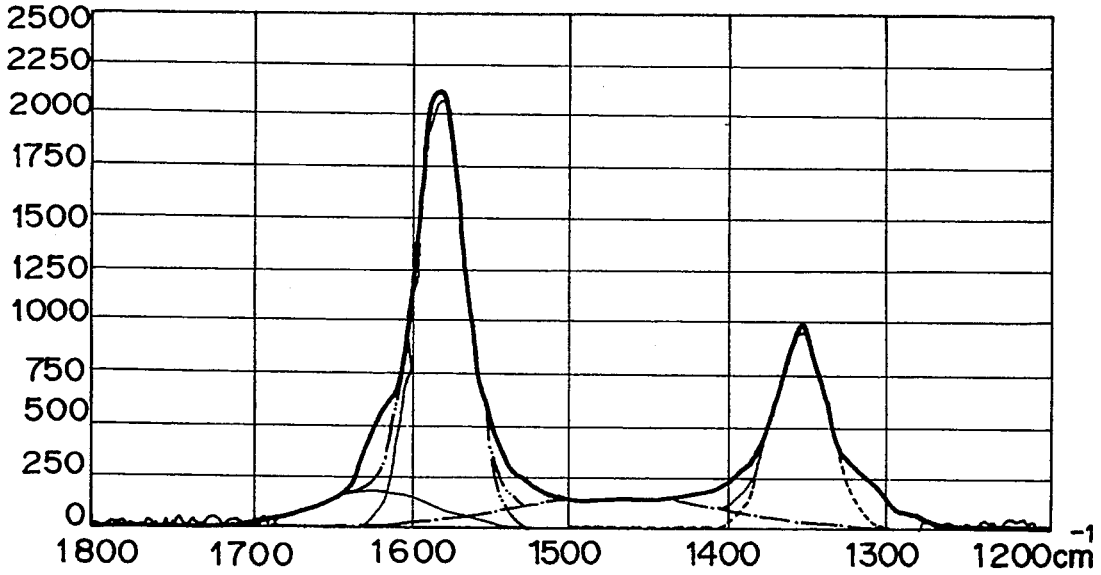

From the analysis of crystalline distribution in the radial direction in the cross-section perpendicular to the fiber axis according to the laser Raman spectroscopy, it was revealed that, as shown in FIG. 3, the ion implanted graphite fiber had a region spanning from the surface of single filament to a depth of 0.8 μm, in which the degree of crystallinity was reduced. In FIG. 3, curves A and B correspond to the graphite fiber after ion implantation and the graphite fiber before ion implantation, respectively. In this analysis, laser Raman spectral data were obtained on seven points in the region spanning from the filament surface to a depth of 0.8 μm, and $\nu a$ was determined from an average value of the seven spectral data.

The other characteristics of the graphite fiber before and after the ion implantation are shown in Table 4.

TABLE 4

| Ion-implanting conditions | | Elementary analysis | Wide angle X-ray diffractometry | | Half width of peak at 1350 cm$^{-1}$ | |
|---|---|---|---|---|---|---|
| Implantation | | Carbon | Crystal | Degree of | Surface layer | Central |

TABLE 4-continued

| | Ion | quantity (/cm²) | content (%) | size Lc | orientation (%) | portion $\nu a(cm^{-1})$ | portion $\nu b(cm^{-1})$ | $\nu a/\nu b$ |
|---|---|---|---|---|---|---|---|---|
| Comparative Example 2 | — | — | 99.8 | 43 | 90 | 40 | 40 | 1.0 |
| Example 6 | $B^+$ | $10^{16}$ | 99.7 | 41 | 89 | 190 | 40 | 4.8 |
| Example 7 | $B^+$ | $10^{15}$ | 99.7 | 42 | 89 | 70 | 40 | 1.8 |
| Example 8 | $Ar^+$ | $10^{16}$ | 99.7 | 40 | 89 | 250 | 40 | 6.3 |

| | Raman spectroscopy | | | Properties of single filament | | |
|---|---|---|---|---|---|---|
| | Position of peak in 1400–1500 $cm^{-1}$ ($cm^{-1}$) | Position of peack vicinity of 1580 $cm^{-1}$ ($cm^{-1}$) | Peak intensity | Tensile strength (GPa) | Tensile modulus of elasticity (GPa) | Compressive Strength (GPa) |
| Comparative Example 2 | 1470 | 1581 | 0.05 | 3.23 | 392 | 3.53 |
| Example 6 | 1470 | 1583 | 0.55 | 4.21 | 390 | 7.45 |
| Example 7 | 1481 | 1583 | 0.30 | 4.02 | 390 | 5.49 |
| Example 8 | 1491 | 1585 | 0.80 | 4.12 | 390 | 7.35 |

EXAMPLES 7 and 8

Ion-implanted graphite fibers were produced in the same manner as described in Example 6 except that the ion-implanting conditions were changed as shown in Table 4. The properties of the obtained ion-implanted graphite fibers are shown in Table 4.

EXAMPLES 9 through 11

Using the same oxidized fiber as that used in Example 1, various carbon fibers and graphite fibers were produced wherein the temperature elevating rate was 200° C./min in a temperature range of 350° to 500° C. in a nitrogen atmosphere, the drawing ratio was 8%, and the highest carbonization temperature was set at 1,600°, 1,800° and 2,000° C. with all other conditions remaining substantially the same, and ion implanting treatment was carried out in the same manner as described in Example 1. The results are shown in Table 5.

EXAMPLES 12 THROUGH 16

Ion-implanted graphite fibers were produced in the same manner as described in Example 6 except that the ion-implanting conditions were varied as shown in Table 6.

TABLE 6

| | Ion-implanting conditions | | | Crystal size Lc (Å) | Half width of peak at 1350 $cm^{-1}$ | | | Compressive strength of single filament (GPa) | Torsional modulus of elasticity (GPa) | Tensile properties of single filament | |
|---|---|---|---|---|---|---|---|---|---|---|---|
| | Ion | Acceleration voltage (kV) | Implantation quantity (/cm²) | | Surface layer portion $\nu a(cm^{-1})$ | Central portion $\nu b(cm^{-1})$ | $\nu a/\nu b$ | | | Tensile strength (GPa) | Modulus of elasticity (GPa) |
| Example 12 | $Te^+$ | 150 | $10^{15}$ | 42 | 90 | 40 | 2.3 | 6.86 | 28.4 | 4.41 | 392 |
| Example 13 | $Ar^+$ | 150 | $10^{16}$ | 40 | 250 | 40 | 6.3 | 7.35 | 25.5 | 4.12 | 390 |
| Example 14 | $N^+$ | 150 | $10^{17}$ | 40 | 210 | 40 | 5.3 | 7.84 | 26.5 | 4.02 | 387 |
| Example 15 | $Si^+$ | 150 | $10^{15}$ | 41 | 170 | 40 | 4.8 | 7.06 | 27.5 | 4.12 | 392 |
| Example 16 | $B^+$ | 100 | $10^{17}$ | 42 | 70 | 40 | 1.8 | 6.67 | 22.5 | 3.92 | 392 |

EXAMPLE 17 AND COMPARATIVE EXAMPLE 3

The carbon fiber bundle before ion implantation as used in Example 1 was graphitized at a temperature of 2,850° C. to prepare a graphite fiber having a crystal size Lc of 57Å. The graphite fiber was implanted with boron ions in the same manner as described in Example 1 except that the implantation quantity was varied to $5\times10^6/cm^2$. The ion-implanted graphite fiber had a crystal size Lc of 54Å. By the ion implantation, the compressive strength of the single filament was increased from 3.63 GPa to 5.78 GPa.

TABLE 5

| | Calcinating conditions | Elementary analysis | Wide angle X-ray diffractometry | | Half width of peak at 1350 $cm^{-1}$ | | |
|---|---|---|---|---|---|---|---|
| | Higher temperature (°C.) | Carbon content (%) | Crystal size Lc (Å) | Degree of orientation $\pi_{002}$ (%) | Surface layer portion $\nu a(cm^{-1})$ | Central portion $\nu b(cm^{-1})$ | $\nu a/\nu b$ |
| Example 9 | 1600 | 97.1 | 20 | 83.0 | 190 | 140 | 1.4 |
| Example 10 | 1800 | 98.4 | 23 | 85.5 | 190 | 110 | 1.7 |
| Example 11 | 2000 | 99.1 | 27 | 86.5 | 190 | 60 | 3.2 |

| | Raman spectroscopy | | | Properties of single filament | | |
|---|---|---|---|---|---|---|
| | Position of peak in 1400–1500 $cm^{-1}$ ($cm^{-1}$) | Position of peak in vicinity of 1580 $cm^{-1}$ ($cm^{-1}$) | Peak intensity ratio | Tensile strength (GPa) | Tensile modulus of elasticity (GPa) | Compressive Strength (GPa) |
| Example 9 | 1494 | 1591 | 0.47 | 6.27 | 328 | 9.60 |
| Example 10 | 1489 | 1590 | 0.51 | 5.68 | 348 | 8.72 |
| Example 11 | 1486 | 1584 | 0.53 | 4.90 | 368 | 8.04 |

EXAMPLE 18 AND COMPARATIVE EXAMPLE 4

The graphite fiber bundle before ion implantation, used in Example 6, was spread by low-frequency vibrations by using convex and flat vibrating guides, so that the thickness was 1 to 3 times the diameter of the single filament, and the spread fiber was wound on a bobbin together with an aluminum foil used as a lead paper. The fiber wound on the bobbin was set in a vacuum system, withdrawn together with the lead paper, and then wound on another bobbin at a speec of 1cm/min. Boron ions were continuously implanted vertically to the travelling fiber.

The vacuum degree was $1\times10^{-6}$ Torr, the acceleration voltage was 150 kV, and the implantation quantity was $1\times10^{16}/cm^2$. The wound carbon fiber was unwound in the reverse direction and was ion-implanted again, and thus ions were implanted from both the front and back surfaces.

The 0° composite compressive strength of the obtained graphite fiber was 1.35 GPa (Example 18), which was much higher than the composite compressive strength, 1.05 GPa, of the graphite fiber before ion-implantation (Comparative Example 4). The crystal size Lc of the graphite fiber was 43 Å before ion-implantation (Comparative Example 4) and 41 Å after ion-implantation (Example 18).

COMPARATIVE EXAMPLE 5

The carbon fiber bundle before ion implantation, as used in Example 1, was wound on a Pyrex glass frame and heat-treated in hot 60% nitric acid at 120° C. for 45 minutes. Then the treated carbon fiber was washed with water for about 60 minutes, dried in an oven at 120° C., and heat-treated for 1 minute in a nitrogen atmosphere at 700° C. The properties of the obtained carbon fiber are shown in Table 7. The crystal size Lc of the carbon fiber was 18 Å both before and after ion implantation.

In the carbon fiber obtained by the above treatment, the tensile strength was better than that of the untreated fiber (Comparative Example 1), but $\nu a/\nu b$ was 1.0, and the lowering of the crystallinity was unsatisfactory. Accordingly, there was little improvement of the compressive strength of the single filament.

COMPARATIVE EXAMPLE 6

The carbon fiber bundle before ion implantation as used in Example 6 was treated in the same manner as described in Comparative Example 5. The results are shown in Table 7. The value of $\nu a/\nu b$ of the carbon fibers treated as above was 1.0 so the crystallinity by the laser Raman spectroscopy was the same as untreated carbon fibers. The compressive strength of single filament was improved only to a very slight extent by the implantation treatment.

COMPARATIVE EXAMPLE 7

The carbon fiber bundle before ion implantation used in Example 1, was introduced into a tank filled with 30% nitric acid maintained at 50° C. through a ceramic guide, and the fiber was continuously travelled at a speed of 0.4 m/min. An electric current was passed through the carbon fiber at an electricity quantity of 200 coulomb/g of the fiber by a metallic roller disposed just before the tank. The obtained carbon fiber was washed with water, dried, and heat-treated for about 1 minute in a nitrogen atmosphere maintained at 700° C. The properties of the obtained carbon fiber are shown in Table 8. The crystal size Lc of the carbon fiber was 18 Å both before and after ion implantation.

In the carbon fiber obtained by the above treatment, $\nu a/\nu b$ was 1.0 and the same as that of the untreated fiber. There was not any appreciable difference between the untreated fiber and the treated fiber in crystallinity determined by the laser Raman spectroscopy. There was little improvement of the compressive strength of the single filament.

TABLE 8

| | Half width of peak at 1350 $cm^{-1}$ | | | | Properties of single filament | | | |
|---|---|---|---|---|---|---|---|---|
| | Surface layer portion $\nu a(cm^{-1})$ | Central portion $\nu b(cm^{-1})$ | $\nu a/\nu b$ | Crystal size Lc (Å) | Compressive strength (GPa) | Modulus of elasticity (GPa) | Tensile strength (GPa) | Modulus of elasticity (GPa) |
| Comparative Example 7 | 170 | 170 | 1.0 | 18 | 7.84 | 20.6 | 6.27 | 284 |
| Comparative Example 8 | 40 | 40 | 1.0 | 43 | 3.58 | 16.2 | 2.42 | 390 |

COMPARATIVE EXAMPLE 8

The carbon fiber bundle before ion implantation as used in Example 6 was treated in the same manner as described in Comparative Example 7. The results are shown in Table 8.

The values of $\nu a/\nu b$ of the carbon fibers treated as above was 1.0 so the crystallinity by laser Raman spectroscopy was the same as the untreated carbon fibers. The compressive strength of single filament was improved only to a very slight extent by the implantation treatment.

We claim:

TABLE 7

| | Half width of peak at 1350 $cm^{-1}$ | | | | Properties of single filament | | | |
|---|---|---|---|---|---|---|---|---|
| | Surface layer portion $\nu a(cm^{-1})$ | Central portion $\nu b(cm^{-1})$ | $\nu a/\nu b$ | Crystal size Lc (Å) | Compressive strength (GPa) | Modulus of elasticity (GPa) | Tensile strength (GPa) | Modulus of elasticity (GPa) |
| Comparative Example 5 | 170 | 170 | 1.0 | 18 | 7.92 | 21.6 | 6.37 | 282 |
| Comparative Example 6 | 40 | 40 | 1.0 | 43 | 3.62 | 16.8 | 2.98 | 391 |

1. A carbon fiber made from an acrylic fiber, having improved compressive strength, having a crystal size $L_c$ of 15 to 65 angstroms as determined by wide angle X-ray diffractometry, and having regions which have a lower crystallinity in the surface layer portion thereof than in the central portion thereof and whose compressive strength ($\sigma_{cf}$) of a single filament of said carbon fiber, determined by the loop method, satisfies the following formula (I):

$$\sigma_{cf} \geqq 10.78 - 0.1176 \times L_c.$$

2. The carbon fiber according to claim 1, a portion of which contains an implanted element but which does not contain any appreciable amount of implanted element in the central portion of a single filament of said carbon fiber, and wherein the content of the implanted element is highest in the surface layer portion of said single filament.

3. The carbon fiber according to claim 2 wherein said implanted element is selected from the group consisting of elements which are solid at room temperature and molecular ions formed of said elements.

4. The carbon fiber according to claim 2 wherein said implanted element is selected from the group consisting of beryllium, boron, silicon, phosphorus, titanium, chromium, iron, nickel, cobalt, copper, zinc, germanium, silver, tin, molybdenum, tellurium, tantalum, tungsten, gold, platinum, hydrogen, nitrogen, neon, argon, krypton, fluorine, chlorine and boron fluoride and molecular ions formed of a member of said group.

5. A carbon fiber made from an acrylic fiber, having improved compressive strength, having a $\nu a/\nu b$ ratio of at least 1.5 where $\nu a$ is a half width of the scattering peak at 1320 to 1380 $cm^{-1}$ of the laser Raman spectrum of at least part of regions in a surface layer portion of a single filament of said carbon fiber and $\nu b$ is a half width of the scattering peak at 1320 to 1380 $cm^{-1}$ of the laser Raman spectrum of the central portion of said single filament.

6. The carbon fiber according to claim 5, wherein the ratio $\nu a/\nu b$ is at least 2.0.

7. The carbon fiber according to claim 5, which contains an implanted element but does not contain any appreciable amount of implanted element in the central portion of a single filament of said carbon fiber, and wherein the content of the implanted element is highest in the surface layer portion of said single filament.

8. The carbon fiber according to claim 5, wherein the carbon content determined by elementary analysis is at least 98%, the crystal size Lc determined by wide angle X-ray diffractometry is at least 22 angstroms the orientation degree $\pi_{002}$ in the direction of the fiber axis is at least 85%, the peak of modified graphite is observed in the range of 1400 to 1500 $cm^{-1}$ of the laser Raman spectrum of the surface of the single filament, and the intensity of said peak is at least 0.3 times the intensity of a peak of graphite present at 1550 to 1610 $cm^{-1}$.

9. The carbon fiber according to claim 5, wherein the tensile modulus of elasticity of the single filament is at least 340 GPa, the tensile strength of the single filament is at least 3.9 GPa, and the compressive strength $\sigma_{cf}$ of the single filament is at least 4.9 GPa.

* * * * *